United States Patent [19]

Blain

[11] Patent Number: 4,637,495

[45] Date of Patent: Jan. 20, 1987

[54] PRESSURE/VISCOSITY COMPENSATED UP TRAVEL FOR A HYDRAULIC ELEVATOR

[76] Inventor: Roy W. Blain, Bollinger Hofe, D-7100 Heilbronn, Fed. Rep. of Germany

[21] Appl. No.: 785,780

[22] Filed: Oct. 9, 1985

[51] Int. Cl.[4] ..... B66B 1/04

[52] U.S. Cl. ..... 187/29 A

[58] Field of Search ..... 187/29

[56] References Cited

U.S. PATENT DOCUMENTS

| | | | |
|---|---|---|---|
| 3,141,386 | 7/1964 | Loughridge | 91/361 |
| 3,474,811 | 10/1969 | Blain | 137/80 |
| 3,530,958 | 9/1970 | Brannon et al. | 187/29 A |
| 3,977,497 | 8/1976 | McMurray | 187/29 A |
| 4,153,074 | 5/1979 | Risk | 137/596.12 |
| 4,534,452 | 8/1985 | Ogasawara et al. | 187/29 A |

FOREIGN PATENT DOCUMENTS 2658928 7/1978 Fed. Rep. of Germany .

*Primary Examiner*—William M. Shoop, Jr.
*Assistant Examiner*—W. E. Duncanson, Jr.
*Attorney, Agent, or Firm*—Eugene Chovanes

[57] ABSTRACT

An hydraulic elevator control system is provided including a by-pass valve connected between the supply and return of a source that normally supplies pressure fluid to the cylinder of the elevator and a setting valve that is operable by fluid supplied from the operating chamber of the by-pass valve to control the operation of the check valve, thereby to achieve a creeping speed of travel of the elevator car as it approaches a stopping point relative to the floor of a building to compensate for variation in oil temperature and/or pressure that occur through increased loading of the elevator, there is mixed with the primary flow of fluid to the setting valve a secondary flow of pressure—and viscosity—responsive fluid that flows over a long-edged restrictor device.

7 Claims, 3 Drawing Figures

PRESSURE/VISCOSITY COMPENSATED UP TRAVEL FOR A HYDRAULIC ELEVATOR

STATEMENT OF THE INVENTION

This invention relates to a drive control system for a hydraulic elevator.

REFERENCE TO COMPANION APPLICATION

This application is a companion application to my prior U.S. application Ser. No. 600,582 filed Apr. 17, 1984 entitled "Down Valve for the Down Speed Control of a Hydraulic Elevator".

BRIEF DESCRIPTION OF THE PRIOR ART

The present invention is an improvement over the invention of my prior British patent No. 1,378,345 of Dec. 27, 1974 entitled "Drive Control System for a Hydraulic Elevator".

Hydraulic elevators should approach their scheduled stopping positions gently and accurately. To establish alignment of the bottom of an elevator car and a floor when the stopping point is approached from below at a creeping speed of travel during the final stage of approach. Different control systems have been developed for this purpose, which are however dependent in relatively large degrees on load and viscosity, and which incur lack of stopping precision caused as result of said dependency and do not offer optimum riding qualities.

In addition to the above, the time for travel between floors and the amount of electrical energy required during travel are undesirably increased through increased load on the elevator and/or higher oil temperatures effecting the viscosity. This is because higher loads and/or higher temperatures cause a quicker operation of the valve resulting in a shorter slowdown distance and thereby a longer up-creeping distance at slow speed until the floor is reached, than at lower loads and/or temperatures.

Known valves designed to operate independently of laod and viscosity are preponderantly very complex in sructure and therefore difficult to adjust and delicate and unreliable in operation. As distinguished from the invention of the aforementioned U.S. patent application Ser. No. 600,582, instead of the down valve being pressure compensated, a by-pass valve is provided that is pressure compensated. The down valve is a normally closed valve with the main spring holding it closed, whereas the by-pass valve is a normally open valve with the main spring positioned at the opposite end holding the valve open. Also, whereas with the compensated down valve the objective is to maintain a constant flow of oil during down travel of the elevator, the objective of the compensated by-pass valve is to prevent the undesirably quick or hard slow down of an elevator when it is fully loaded against the desirably smooth slow down when the elevator is empty.

SUMMARY OF THE INVENTION

An object of the present invention is to apply pressure and viscosity sensitive compensation devices within the control valve for up travel of an hydraulic elevator in such a way that the smoothness of elevator operation is maintained throughout higher loading and/or higher oil temperature conditions.

Another object of the invention is to apply pressure and viscosity sensitive compensation devices within the control valve for up travel of an hydraulic elevator in such a way as to limit the increase in floor-to-floor traveling time of the elevator throughout higher loading and/or higher oil temperature conditions.

Another object of the invention is to apply pressure and viscosity sensitive compensation devices within the control valve for up travel of an hydraulic elevator in such a way as to limit the additional quantity of electrical energy necessary throughout higher loading and/or higher oil temperature conditions.

Still another object of the invention is to apply pressure and viscosity sensitive compensation devices within the control valve for up travel of an hydraulic elevator in such a way that the devices can be easily and inexpensively built into existing control valves.

BRIEF DESCRIPTION OF THE DRAWING

Other objects and advantages of the invention will become apparent from a study of the following specification, when viewed in the light of the accompanying drawing, in which.

DETAILED DESCRIPTION

Figure 1:
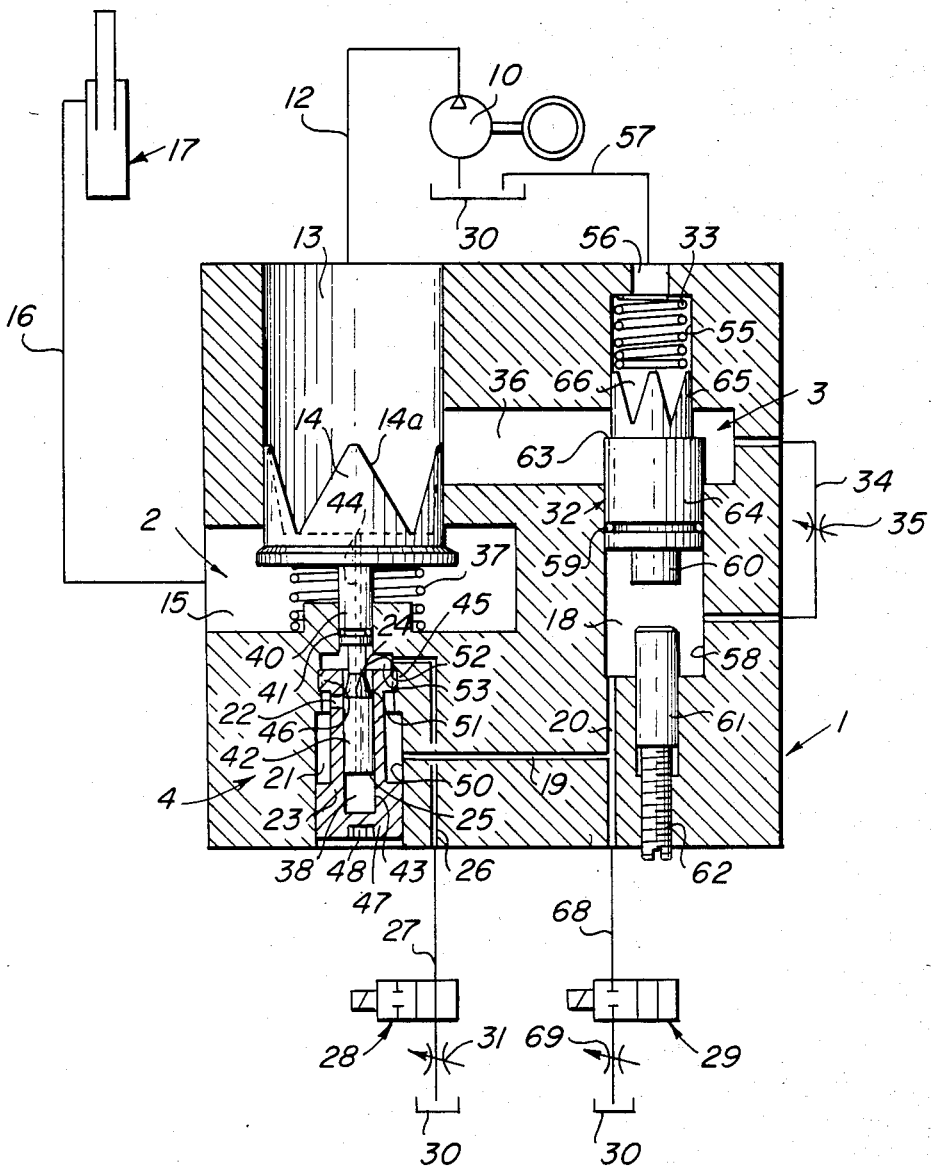
FIG. 1 is a schematic hydraulic circuit diagram illustrating an elevator control system including a by-pass valve in combination with a check valve.

Referring first more particularly to FIG. 1, the illustrated embodiment comprises a valve body 1 containing bores in which are situated a check valve 2, a circulating or by-pass valve 3 and setting valve 4. The valve 4 is described as a "setting valve" throughout the description and claims for easier distinction from the other valves, although it perform several functions within the scope of the regulating creeping speed of travel of the lift, which functions will become apparent from the drawing and the following description. A pump 10, in communication with a pump chamber 13 via conduit 12 serves as a source of pressure fluid. Conduit 16 leads to an elevator cylinder 17 from a chamber 15 formed in the valve body 1.

The check valve 2 includes a crown-shaped valve portion 14 slidably guided in the control block pump chamber 13 which valve portion includes V-shaped restriction slots. The valve element 14 is biased upwardly in a direction toward the pump chamber 13 by check valve spring 37 so that the check valve 2 automatically closes upon reduction of the pressure in the control block pump chamber 13, thereby to prevent return of hydraulic oil from the elevator cylinder 17 to the chamber 13.

The setting valve 4 is arranged co-axially relative to the check valve 2. To this end, the valve element 14 has a cylindrical extension 40 which is slidingly guided and sealed by means of an O-ring 41 in a corresponding bore contained in the valve body 1. A setting element 25 of the setting valve 4 is connected in interlocking fashion to the valve element 14 of the check valve 2 by means of the extension 40. The setting element 25 has cylindrical portion 42 which is arranged in a sealed but displaceable and rotatable manner in a central bore 43 of a setting valve sleeve 23. A plunger compartment 38 is connected by a central bore 44 with the pump chamber 13, thereby producing a pressure equalization in order to secure a constant creeping of travel of the lift independently of the operating pressure. The setting valve sleeve 23 is equipped with a screw-threaded extension 45 by means of which it can be adjustably screwed into a corresponding internal screw-thread 46. The sleeve 23 is closed off at a lower base portion 47 but has a hexagonal recess 48 for adjustment purposes. The sleeve 23 has a lower shank portion which is guided in sealed fashion in a bore 50 of the setting valve 4. An appropriate recess forms an annular gap 21. In a front area of sleeve 23, a setting valve bore 22 leads from said front area to the central bore 43 wherein the setting element 25 is displaceably located. The setting valve bore 22 has a diameter of 2 mm. It may however, alternately, have diameters within the range from approximately 1 mm to approximately 3 mm, or it may consist of several individual bores formed in an axial direction and arranged peripherally staggered relative to each other. A slot may be provided instead of a bore. The size of this opening will naturally depend on the other dimensions of the control pipes and restrictors. At a correct setting, a control edge 24 of the setting element 25 is situated in the area of the setting valve bore 22. A conical control surface 51 sloping with small taper extends in a direction towards the sealing element 14 from the control edge 24. The surface 51 is formed with an angle of inclination of approximately 2 degrees and is divided by as sharp an edge 24 as possible from the cylindrical part 42 of the setting element 25. The control surface 51 is continued at a top portion thereof by a cylindrical shank portion 52. Around the shank portion 52 and over the threaded extension 45 an annular space 53 is formed. A setting valve overflow passage 26 leads out of the annular space 53, which passage is connected with an inlet of an electromagnetic valve 28 via a setting valve outflow conduit 27. The electromagnetic valve 28 is a 2-position valve which is arranged to be switched to the illustrated conducting position in which throughflow occurs (O-position) when the valve 28 is de-energized, and to a blocking position to block the throughflow when it is energized. An outlet of the valve 28 is connected with an oil collection vessel 30 via a setting valve discharge restrictor 31.

A circulating valve passage 36 branches off from the pump chamber 13, above the valve element 14. An outlet bore 55 leads upwards from the duct 36. The bore 55 is followed by a smaller diameter outlet 56 from which a circulating valve outlet conduit 47 leads to the oil collection vessel or sump 30. Coaxially with the outlet bore 55 and situated on the other side relative to the circulating valve passage 36, is located a valve bore 58 which has a slightly greater diameter than the outlet bore 55. A cylindrical circulating valve element 32 is guided in an axially displaceable manner in the valve bore 58. The element 32 is sealed by an O-ring 59 and has an extension 60 which, for limitation of the stroke of the element is arrange to strike against an abutment member 61 which is mounted for axial adjustment in the control block 1 by means of a screw-threaded extension 62. A circulating or by-pass valve chamber 18 is formed below the circulating valve element 32. The small difference in diameter between the bores 55 and 58 results in the formation of a very small annular surface 63 between a cylindrical part 64 of the valve element 32 sliding in the cylindrical valve bore 58, and guiding extension 65 having V-shaped restrictor slots 66. The circulating valve element 32 is biased in an opening direction by means of a relatively powerful circulating valve spring 33 pressing against the guiding extension 65. The strength of the circulating valve spring 33 is chosen with regard to the operating pressures and effective surfaces on the circulating valve element 32 that it provides a major portion of the opening force and is assisted to a relatively small extent by the pressure acting on the annular surface 63. A circulating valve pipe 34 leads to the circulating valve chamber 18 through an adjustable restrictor 35 from the circulating valve passage 36 which is connected directly to the source of pressurized fluid 10. The adjustable restrictor 35 is appropriately formed as needle valve because it then provides substantially greater viscosity equalization that other forms of restrictors. From the otherwise sealed circulating valve chamber 18, a passage 20 leads on the one hand into a setting valve feed passage 19 which onpens into the annular gap 21, and on the other hand through a circulating valve chamber outlet conduit 68 to a solenoid valve 29 for the circulating valve chamber 18. The solenoid valve 29 is, like valve 28, a 2-position valve which is set to a normal first position allowing throughflow (O-position) when the valve 29 is de-energized, and a second position preventing throughflow when the valve 29 is energized. The output from the valve 29 is ducted to the oil collection vessel 30 through an adjustable restrictor 69.

The lift drive control system has been illustrated in a position wherein it is set for creeping speed travel of the lift, and wherein the individual valves are in hydraulic equilibrium. The magnetic valve 28 is not energized, whereas the magnetic valve 29 is energized and consequently maintains the duct 29 in a closed position.

OPERATION

The control system operates in the following manner:

The pump 10 supplies hydraulic oil into the pump chamber 13 via the conduit 12 when an elevator car, arranged on the elevator cylinder 17, is traveling upwardly at full speed. The solenoid valves 28 and 29 are energized, and consequently conduits 27 and 68 are in closed conditions. This prevents oil from flowing out of the pump chamber 13 via by-pass or circulating valve passage 36, circulating valve conduits 34, adjusting restrictor 35 and circulating valve chamber 18, and then either via conduit 68, or via passage 19, setting valve 4 and passage 26. The pump pressure cannot diminish in circulating valve chamber 18, and hence the pump pressure prevailing in the circulating valve chamber 18 maintains the circulating valve element 32 in a closed position against the force of the spring 33, so that no oil can flow out through the circulating valve 3. Consequently, the check valve 2 is held open, the valve element 14 being displaced against the force of the spring 37 and opening the passage to the control block cylinder 15, so that the entire volume of oil delivered by the pump 10 is fed to the cylinder 17 via check valve 2, chamber 15, and cylinder conduit 16, and the elevator car is consequently driven upwardly at full speed corresponding to the pump delivery volume. This position of the lift drive control system has not been illustrated.

To switch the elevator car traveling at full speed to creeping speed travel prior to reaching a stopping point, the solenoid of the valve 28 is de-energized so that the valve 28 is switched to its illustrated throughflow position. The oil now flows out of the circulating valve chamber 18 to sump 30 via passages 20 and 19, annular gap 21, past the setting valve bore 22 on the control surface 51, through annular space 53, setting valve outflow 27, solenoid valve 28 and setting valve restrictor 31. The pressure in the circulating valve chamber 18 drops correspondingly, so that the force exerted by the pressure on the circulating valve element 32 is no longer sufficient to overcome the force of the spring 33.

Figure 2:
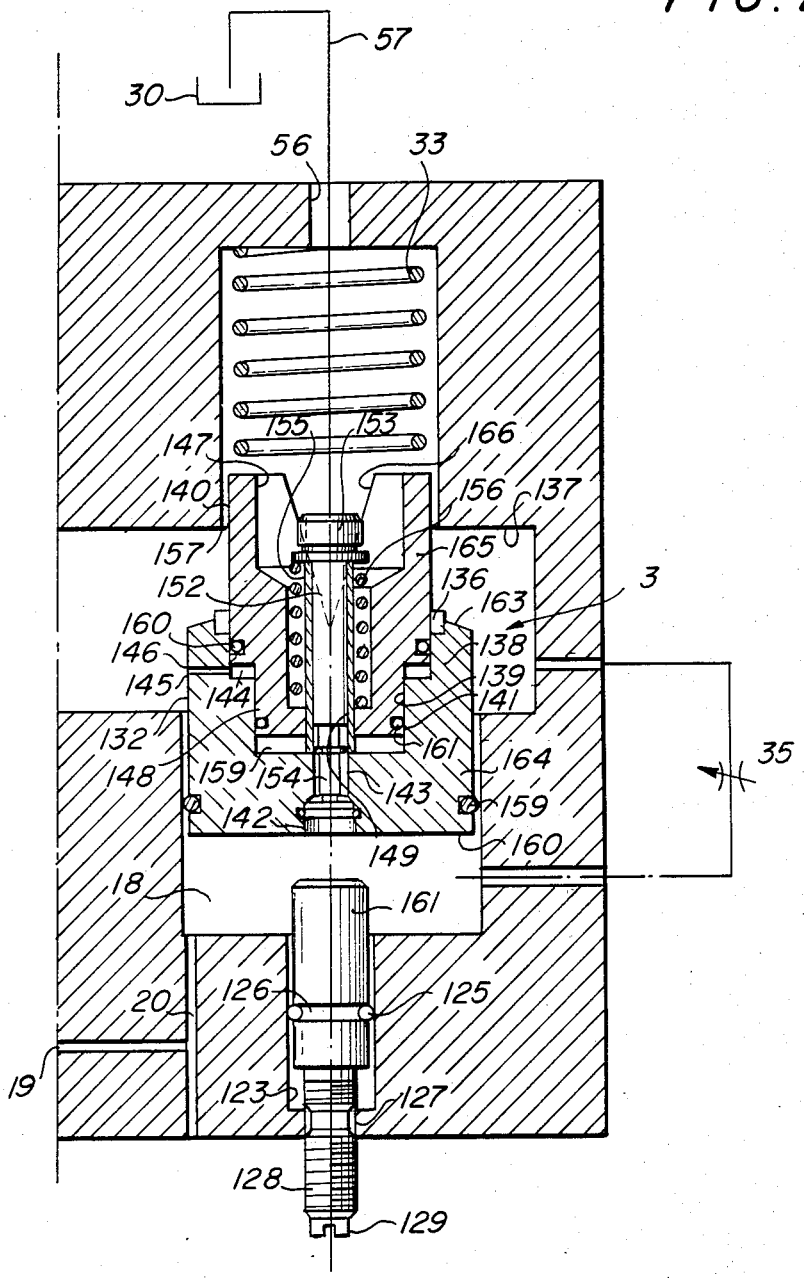
FIG. 2 is a detailed schematic diagram of a modification of the system of FIG. 1 wherein the by-pass valve has a construction that is generally similar to the down valve of the aforementioned U.S. application Ser. No. 600,582.

In the by-pass circulating valve arrangement shown in FIG. 2, the pressure fluid acts through channel 145 into the positioning chamber 144 and upon the bottom of plug 165 and upon the area of the sealing ring 136, thereby causing the flow metering plug 165 to move upwardly relative to the sealing plug 164 against the resistance of compensating spring 156, thereby causing the opening of the restrictor slots 166 to shift to their restricted section so that upon the occurrence of the slow-down signal from the appropriate electrical slow down switch in the elevator shaft, the resulting movement of the sealing plug 164 away from the seat face 137 commences with a narrower section of the restrictor slots 166 being exposed to the pressurized oil from the pump, resulting in the delaying of the bypassing process of the by-pass or circulating valve 3 and thereby retarding the slowing down phase of the elevator car. This contrasts to the deficient condition of a circulating valve with a metering guide extension and sealing plug 164 rigidly attached together.

The force rate of the compensating spring 156 and the geometry of the restrictor slots 166 are matched to each other, also to the pressure range of the hydraulic elevator system as well as to the compensating effect of the pressure/temperature dependent volume of oil flowing over the long-edged restrictor ring 170 (FIG. 3) such that the compounded effect produces a rate of speed reduction to the elevator car whose difference in rate is barely distinguishable whether the elevator car is empty or fully loaded.

Figure 3:
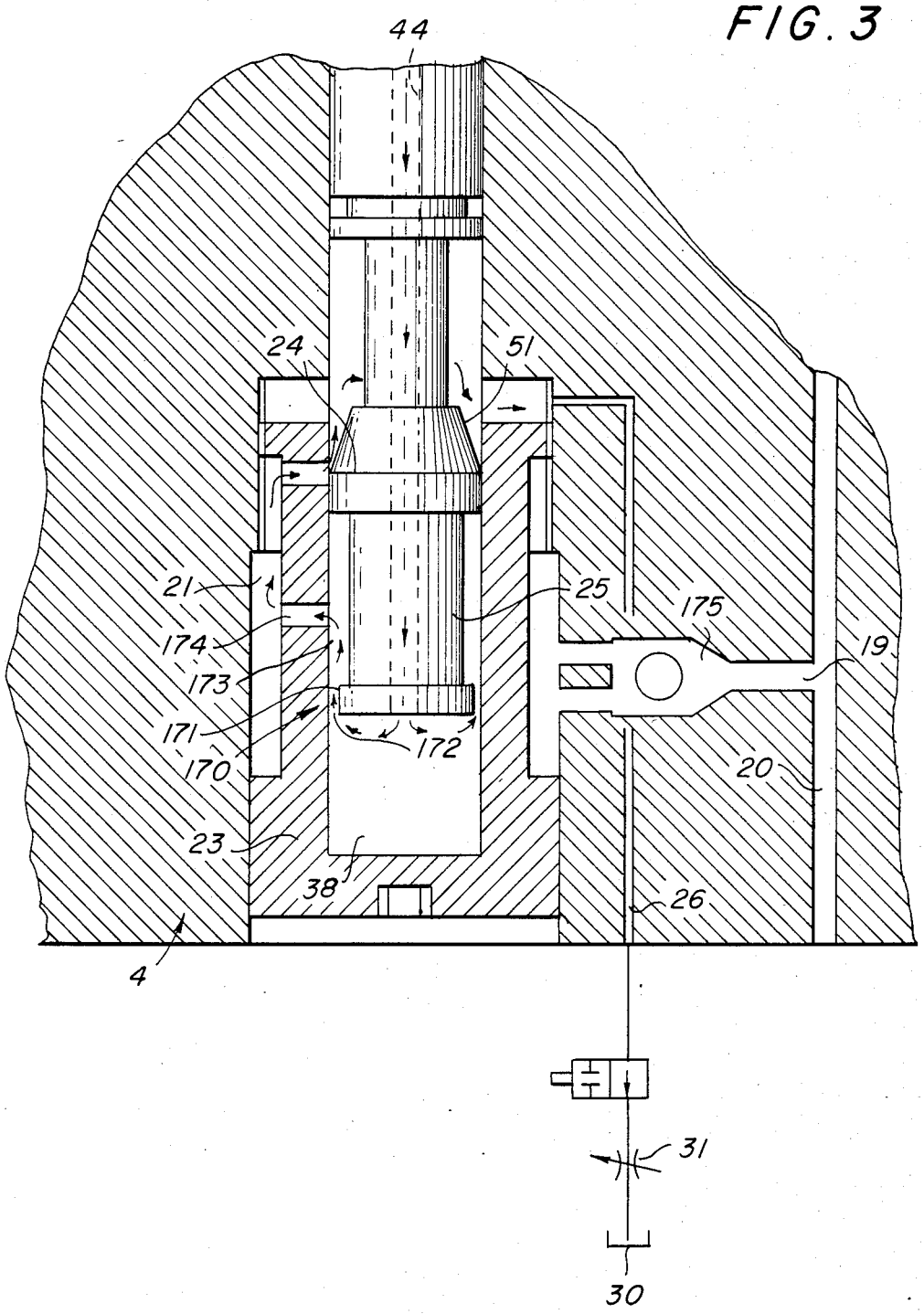
FIG. 3 is a detailed view of the improved setting valve construction of the present invention.

Referring to FIG. 3, at higher pressures and/or temperatures, the circulating valve tends to open quicker than at lower oil pressures and/or temperatures which would cause an uncomfortably quick rate of speed reduction of the elevator car. This tendency however is partially neutralized by the pressure-viscosity dependent volume of oil flowing through the central bore 44 over the long-edged restrictor 170 into annular chamber 173 through restrictor orifice 174 and into annular gap 21 where it collects with oil flowing out of the circulating valve chamber 18, thus retarding the latter's escape over control surface 51 and through setting valve restrictor 31 into oil collector vessel 30. The opening of circulating valve 3 at higher pressures and/or oil temperatures is thereby slower than what it otherwise would have been and an uncomfortably quick deceleration followed by an overly long up creep distance is avoided. Further, the additional volume of oil flowing over control edge 24 at higher pressures and/or temperatures leads to an opening movement of control surface 51 relative to control edge 24 effecting the hydraulic equilibrium between the check valve 2 and the circulating valve 3 such that the creeping speed is increased slightly above what it otherwise would have been, and bringing the advantages of shortened traveling time and reduced energy loss. The volume of viscosity dependent fluid passing over the restrictor 170 is suited to the volume of oil flowing in through adjusting restrictor 35 and out of the circulating valve chamber 18 so that the desired amount of compensating effect is acquired. The dimensions of the annular space 172 between restrictor ring 171 and bore 50 are of significance in this respect as is the size of the restrictor orifice 174 which serves to prevent an excess of viscosity compensating oil collecting with oil from the circulating valve chamber 18 which could otherwise cause an over travel of the elevator. Check valve 175 prevents oil from flowing over the restrictor ring 171 through setting valve feed passage 19 into the circulating valve chamber 18 where it would otherwise cause interference with the function of the adjusting restrictor 35 controlling upward acceleration phase of the elevator.

Reverting again to FIG. 1, the circulating valve element 32 thus opens the by-pass or circulating valve 3 so that part of the volume of oil delivered by the pump 10 flows to the oil collection vessel 30 through the circulating valve 3 and conduit 57. This reduces the volume of oil fed to the elevator cylinder 17 and the check valve 2 begins to close under the thrust of the spring 37. The amount of closing of the check valve 2 is proportional to the amount of opening of the circulating valve 3. During the closing of the check valve 2, the setting element 25 of the setting valve 4 is also displaced with the valve element 14, in such manner that the flow passage of valve 4 is reduced, the control edge 24 simultaneously partly covering the setting valve bore 22. This reduces the volume of oil issuing from the circulating valve chamber 18 in such manner that it corresponds to the volume of oil which is fed to the circulating valve chamber 18 through the adjusting restrictor 35. When this stage is reached, the system is in a state of hydraulic equilibrium during which a constant volume of oil flows to the elevator cylinder 17 through the check valve 2 and the residual volume of oil supplied by the source of pressurized fluid flows out to the oil collection vessel 30 through the circulating valve passage 36 and the circulating valve 3. A creeping speed of travel has now been reached. The creeping speed of travel depends on the adjustment of the setting valve bore 22 with respect to the control edge 24. The creeping speed of travel may be adjusted by axially displacing the sleeve 23 by rotating the sleeve 23 relative to its threaded bore. The area of operation during creeping speed travel is such that the control edge 24 is positioned approximately in the area of the setting valve bore 22. Before this position is reached, however, the control surface 51 becomes active in such manner as to prevent excessive opening of the circulating valve 3, thereby preventing an undesirable reduction of the speed of travel below the creeping speed, so that a change from full speed to creeping speed of travel can occur smoothly without jolting. The system is self-governing, adjusting itself for creeping speed travel, of the lift once the creeping speed has been preset, the valve element 14 of the check valve 1 and the setting element 25 of the setting valve 4 simultaneously being floatingly situated in all operating positions during creeping speed travel, and not bearing against fixed stops or the like.

During creeping speed travel the elevator cylinder 17 moves slowly upwardly toward the stopping point, and once this stopping point has been reached, the solenoid valve 29 is energized and switched to a position allowing throughflow by means of another signal triggered off by the elevator car (for example, so that the circulating valve chamber 18 is relieved of pressure and the circulating valve 3 opens fully under the thrust of the spring 33, whereupon the entire volume of oil delivered by the pump 10 flows out to the oil collection vessel 30 through the conduit 57). The check valve 2 simultaneously closes completely under the action of the spring 37 and prevents oil from flowing back from the elevator cylinder 17 and the elevator from unintentionally dropping.

A switching operation of the control system which is smooth and favorably affects riding qualities may be established by means of the different adjustable restrictors. The maximum opening of the circulating valve 3 is adjusted by means of the stop 61. Complementary control systems required for downward travel have not been illustrated.

The structural embodiment of the control system and of its individual components may be modified in various ways, in which connection it is of importance, however, that a primary flow of pilot oil through the input restrictor controlling the speed of closing of the circulating valve, and upon the switching of the elevator car into creeping speed, the same pilot oil flow escaping through the discharge restrictor serving as the medium to control the speed of opening stroke of a circulating valve and equally serving as the medium, in conjunction with a creeping speed setting valve positioned between the circulating valve chamber and oil collection vessel, to control the length of opening stroke of the circulating valve element, is joined by the secondary pressure and viscosity dependent volume of pilot oil which however is prevented from influencing the closing of the circulating valve by a check valve, and that the once united flow of the two volumes of pilot oil pass through the setting valve controlling the continued flow rate of escape of the combined flow and the discharge restrictor limiting its initial rate of escape and thereby the speed of opening of the circulating valve element which consists of the main oil flow metering guiding extension with restrictor slots, fluid pressure and spring dependently caused to move within the cylindrical part into which it closely fits and the combined parts comprising the circulating valve element able to move within the valve housing bore to effect the opening and closing of the passage for the main oil flow from the source of pressurized fluid to the collecting vessel.

What is claimed is:

1. In an hydraulic elevator control system including a pressure fluid source (10) having a supply and a return, means including a check valve (2) connecting the supply of said source with a cylinder 17 of the elevator, and means including a by-pass valve (3) connected across said source for by-passing said check valve, said by-pass valve normally being biased by biasing means (33) to the open condition and including a by-pass chamber (18) for receiving pressure fluid from said source via a fluid restrictor (35) for displacing said by-pass valve to the closed condition against the force of said biasing means, and means including a solenoid valve (29) operable to connect said chamber with the return of said source and setting valve means (4) for controlling the operation of said check valve means as a function of the pressure of fluid in said by-pass chamber; the improvement which includes means (44,170) for mixing with the fluid supplied from said by-pass chamber to said setting valve a secondary volume of fluid that flows over pressure and viscosity sensitive long-edged restrictor means (170).

2. Apparatus as defined in claim 1, wherein said setting valve means includes a setting valve sleeve (23), and a setting member (25) mounted in concentrically spaced relation for longitudinal displacement within said sleeve and further wherein said long-edged restrictor means comprises a narrow annular ring (171) mounted on said setting member in concentrically spaced relation within said sleeve member.

3. Apparatus as defined in claim 2, wherein said long-edged restrictor includes an area of opening of such form that it is bounded by elongated edges resulting in the volume of oil flowing through the opening to have extended contact with the surfaces of the opening and therefore to be highly pressure and viscosity dependent.

4. Apparatus as defined in claim 1, and further including check valve means (175) for isolating said by-pass chamber (18) from said secondary flow of pressure—and viscosity—dependent volume of pressure fluid.

5. Apparatus as defined in claim 1, and further including means including a restrictor orifice (174) for preventing an excess of the secondary volume of pressure—and viscosity—dependent fluid from joining with the primary volume of pressure fluid supplied from said by-pass chamber to said setting valve means.

6. Apparatus as defined in claim 4, wherein said by-pass valve comprises a valve member (165) having a flow metering guiding extension with tapered restrictor slots (166) the effective dimensions of which depend on system pressure, said valve member being displaced relative to its cooperating sealing plug (164) by pressure fluid in a positioning chamber (144) acting in a given direction thereon, said valve member being biased for movement in the opposite direction by a compensating spring 156.

7. Apparatus as defined in claim 4, wherein the speed of displacement of the guide extension, with restrictor slots relative to the cylinder part, is limited by a small orifice through which pressurized fluid enters the positioning chamber between the two parts.

* * * * *